US008844737B2

(12) United States Patent
Bukowski

(10) Patent No.: US 8,844,737 B2
(45) Date of Patent: Sep. 30, 2014

(54) LOW-PROFILE DRYING RACK

(71) Applicant: Marsha Bukowski Design Studio LLC, New York, NY (US)

(72) Inventor: Marsha Bukowski, New York, NY (US)

(73) Assignee: Marsha Bukowski Design Studio LLC, New York, NY (US)

( * ) Notice: Subject to any disclaimer, the term of this patent is extended or adjusted under 35 U.S.C. 154(b) by 0 days.

(21) Appl. No.: 13/929,135

(22) Filed: Jun. 27, 2013

(65) Prior Publication Data

US 2014/0001135 A1 Jan. 2, 2014

Related U.S. Application Data

(60) Provisional application No. 61/665,963, filed on Jun. 29, 2012.

(51) Int. Cl.

| | |
|---|---|
| ***A47F 5/08*** | (2006.01) |
| ***D06F 57/08*** | (2006.01) |
| ***D06F 57/12*** | (2006.01) |

(52) U.S. Cl.

CPC ..... *D06F 57/12* (2013.01)
USPC ..... 211/100; 211/104

(58) Field of Classification Search

USPC ..... 211/1.3, 6, 16, 85.24, 85.3, 88.04, 211/94.03, 96, 97, 98, 99, 100, 101, 102, 211/103, 104, 113, 119.004, 197, 198, 200, 211/202, 204, 206

See application file for complete search history.

(56) References Cited

U.S. PATENT DOCUMENTS

| | | | | | |
|---|---|---|---|---|---|
| 62,159 | A | * | 2/1867 | Sickels | 211/99 |
| 122,280 | A | * | 12/1871 | Putnam et al. | 211/99 |
| 149,335 | A | * | 4/1874 | Porter et al. | 211/99 |
| 313,223 | A | * | 3/1885 | McMaster | 108/135 |
| 426,313 | A | * | 4/1890 | Paxson | 211/99 |
| 620,905 | A | * | 3/1899 | Gardner | 211/85.3 |
| 819,989 | A | * | 5/1906 | Gilbert | 211/48 |
| 1,039,694 | A | * | 10/1912 | Burton | 108/163 |
| 1,281,318 | A | * | 10/1918 | Elmendorf | 211/104 |
| 1,435,183 | A | * | 11/1922 | Shepherd | 211/99 |
| 1,984,827 | A | * | 12/1934 | Derman | 312/4 |
| 2,402,768 | A | * | 6/1946 | Murphy et al. | 211/99 |
| 2,908,397 | A | * | 10/1959 | Patterson | 108/179 |
| 2,956,689 | A | * | 10/1960 | Togt | 211/86.01 |
| 3,295,471 | A | * | 1/1967 | Cook | 108/163 |
| 3,627,142 | A | * | 12/1971 | Steiner | 211/119.1 |
| 8,281,943 | B2 | * | 10/2012 | Suman et al. | 211/150 |
| 8,453,852 | B2 | * | 6/2013 | Raddatz | 211/85.24 |
| 2004/0007549 | A1 | * | 1/2004 | Klein et al. | 211/118 |
| 2004/0074858 | A1 | * | 4/2004 | Thuma et al. | 211/202 |

* cited by examiner

*Primary Examiner* — Joshua Rodden
(74) *Attorney, Agent, or Firm* — Powley & Gibson, P.C.

(57) ABSTRACT

Drying devices facilitating air drying of assorted items without taking up significant floor space are disclosed. In an aspect, a drying device includes a frame mountable to a vertical surface such as a door, wall, or fence. The drying device includes a plurality of drying areas which may be moved between a stored position and a drying position. In the stored position, the drying device has a compact profile, thereby occupying very little space when not in use. In the drying position, the drying areas extend away from the frame and may support articles, such as clothing, as the articles dry.

15 Claims, 6 Drawing Sheets

LOW-PROFILE DRYING RACK

CROSS-REFERENCE TO RELATED APPLICATION

This application claims the benefit of U.S. Provisional Patent Application No. 61/665,963, filed Jun. 29, 2012, and entitled "Improved Low-Profile Drying Rack," the entire contents of which is incorporated herein by reference.

FIELD OF THE DISCLOSURE

The present disclosure relates to devices for drying assorted items and more particularly to passive drying devices for assorted items.

BACKGROUND

The statements in this section merely provide background information related to the present disclosure and may not constitute prior art.

Laundering of clothing and other articles is a frequent, recurring chore in many households. Free standing drying racks are often used to dry clothing after it has been washed or where an item gets wet and an individual wishes to dry the item quickly, but without using an electric or gas dryer. Use of conventional, free-standing drying racks requires time consuming setup before drying can begin, involving the impairment of valuable floor space in the home while the rack is in use, and requiring another round of time consuming break down and storage after drying has been completed. This process then requires repeating the next time the laundry is washed. These shortcomings are exacerbated when considering that many people must do laundry in tight living quarters, such as dormitories, barracks, shared housing, small urban apartments, and the like.

Further, conventional, portable, free standing racks also present potential dangers to pets, children, and adults alike because the unsecured rack can easily be knocked over. Other drying racks are designed to be mounted on the wall. Some wall mounted drying racks tend to protrude a significant amount from the wall, creating a safety hazard.

Given the foregoing, what is needed are improved low-profile drying devices capable of being used and stored in tight living quarters.

SUMMARY

This Summary is provided to introduce a selection of concepts in a simplified form that are further described below in the Detailed Description. This Summary is not intended to identify key features or essential features of the subject matter, nor is it intended to be used to limit the scope of the subject matter.

This disclosure addresses the above-described needs by providing devices configured to facilitate the air drying of assorted items. Assorted items include, but are not limited to, laundry of all shapes, sizes, and types.

Aspects of the present disclosure provide a device configured to facilitate air drying assorted items, such as laundry, without taking up significant floor or wall space. Devices configured in accordance with an aspect of the present disclosure are small, compact racks that can be secured to the front or back of a door or can be removably mounted to a wall and can be easily folded down for use. Products according to the present disclosure are ideal for laundry rooms or other small areas that may not have adequate floor or wall space for traditional drying racks. They may also eliminate the need to use an (electric) dryer, thereby saving energy and reducing utility bills.

In an aspect, a drying device is configured to conserve space both when in and out of use by being removably mounted on a standard interior door or wall. At least one hook is placed over the top of the interior door which supports the weight of the drying device and any objects placed on the drying device. A rigid frame is attached to the hooks and one or more drying arms are moveably attached to the rigid frame. When in use, at least one of the drying arms is placed in its drying position by rotating the arm into a position approximately perpendicular to the rigid frame. Objects to be air dried are placed on the extended drying arm to dry. When the device is not in use, it is configured to be left on the door, protruding mere inches. In some aspects where the device is not in use, the device is additionally or alternatively configured to be removed from the interior door and folded into a compact form for storage. Such a configuration eliminates the conventional cumbersome drying racks that utilize living areas and obstruct walkways. Some aspects do not require permanent mounting to install on a door.

Some aspects of the disclosed drying device are configured to dry the equivalent of 22 linear feet of laundry at one time. Other aspects are configured to dry higher volumes of laundry simultaneously.

Further features and advantages of the systems and apparatus disclosed herein, as well as the structure and operation of various aspects of the present disclosure, are described in detail below with reference to the accompanying figures.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

DETAILED DESCRIPTION

The present disclosure is directed to devices configured to facilitate the air drying of assorted items. Assorted items include, but are not limited to, laundry of all shapes, sizes, and types. In some aspects, devices configured in accordance with the present disclosure are adapted to assist air-drying laundry of all shapes, sizes, and types. Specifically, aspects in accordance with the present disclosure are suitable for facilitating the drying of clothing, linens, and sheets of fabric.

In an aspect, a drying device comprises a frame and one or more drying arms. The drying device is configured to hang from two hooks attached to a frame top portion of the drying device. The drying device is deployed by placing hooks over the top of a vertical surface such as a door, fence, or wall. One or more drying arms are rotatably connected to frame and configured to rotate into a drying position which is perpendicular to frame and vertical surface. Miscellaneous objects are placed on the extended drying arm to dry. Drying is facilitated by spacing assorted items on the drying arms such that substantially all of the surface area of the assorted items is exposed to the surrounding air.

In some aspects when the drying device is not in use, it is configured to be left on the vertical surface, protruding a distance on the order of frame depth. Drying arms are rotated into storage position substantially in parallel with the drying device frame. In some aspects where the drying device is not in use, the device is additionally or alternatively configured to be removed from the interior door and folded into a compact form for storage.

Figure 1:
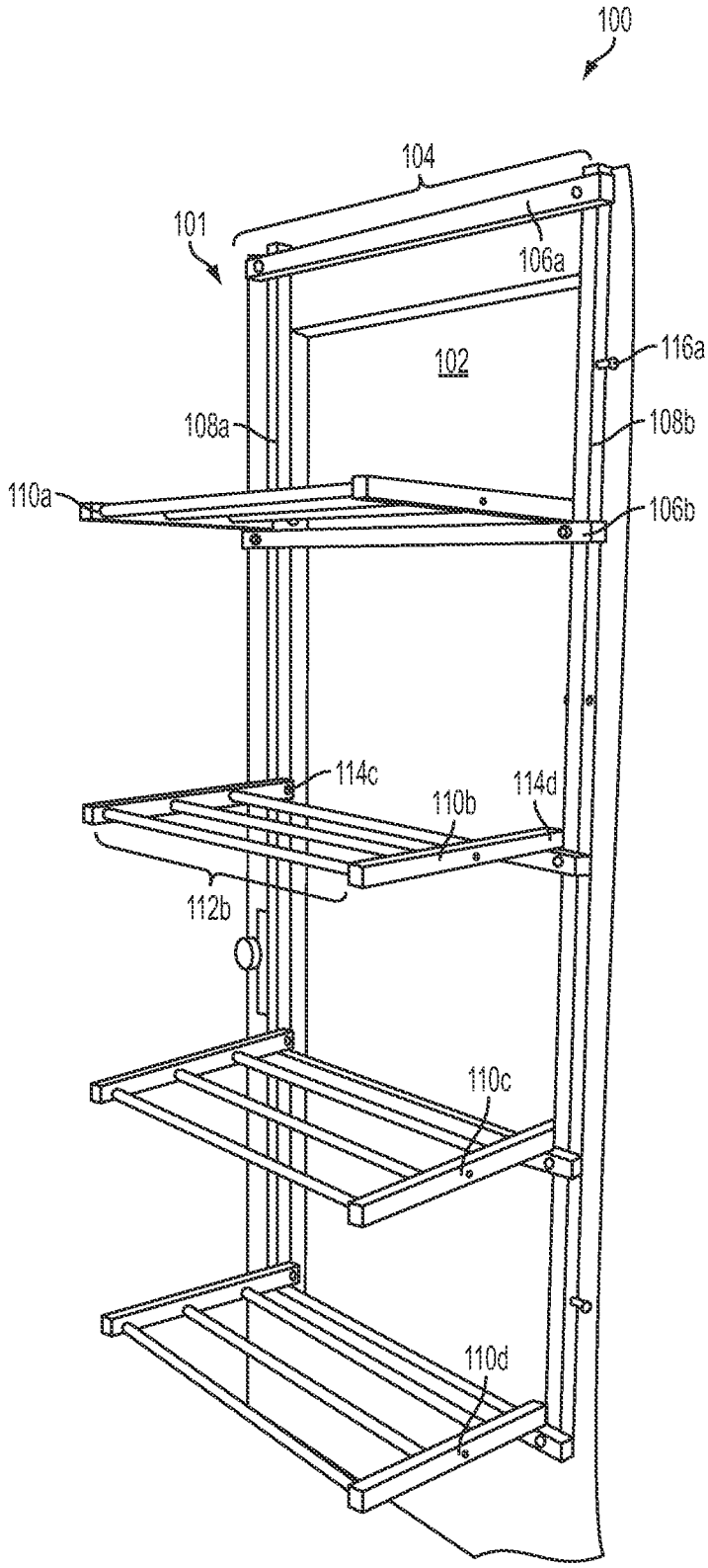
FIG. 1 is an illustration of a three-quarters view of the front of an exemplary drying device wherein the device's drying arms are in the drying position, in accordance with an aspect of the present disclosure.

Referring to FIG. 1, an illustration 100 of a three-quarters view of the front of an exemplary drying device 101 wherein the device's drying arms are in the drying position, in accordance with an aspect of the present disclosure, is shown.

Drying device 101 comprises a frame 104 and one or more drying arms 110 (shown as drying arms 110*a-d* in FIG. 1). Frame 104 is a rigid support structure configured to orient drying device 101 on a vertical surface 102 such as a as a door, fence, or wall and support the weight of drying device 101 and assorted items placed thereon. Frame 104 is constructed of one or more sturdy materials such as plastic, metal, or wood. In some aspects, frame 104 material may be configured to be lightweight, enabling drying device 101 to be easily set up and removed each time it is used to dry assorted items. In an aspect, the material chosen for frame 104 is used throughout the rest of drying device 101, facilitating ease of manufacture.

In an aspect, frame 104 comprises one or more cross members 106 (shown, for clarity, only as cross members 106*a-b* in FIG. 1) and one or more vertical members 108 (shown as vertical members 108*a-b* in FIG. 1). In an aspect, vertical member 108 defines the overall length of drying device 101. The length of vertical member 108 is chosen such that drying device 101 may be mounted on a vertical surface 102, such as an interior door. In an aspect, vertical member 108 is five feet, eight inches long; one foot shorter than the height of a standard interior door (six feet, eight inches). Two vertical members 108 are horizontally positioned two feet apart and rigidly connected by five cross members 106 spaced at equal intervals along the length of vertical members 108.

In an aspect, cross members 106 are rigidly connected to vertical members 108 at end portions of cross member 106. Rigid connection may be made by a fastener, adhesive, screw, dowel rod, or other connection means as will be appreciated to those having skill in the relevant art(s) after reading the description herein. The rigid connection may be permanent, as in the case of utilizing an adhesive. In other aspects, the rigid connection is removable, as in the case of utilizing a fastener or screw connection.

In an aspect, frame 104 is constructed of one-inch bars. These bars may be made of wood or some other suitable sturdy material. In another aspect, frame 104 further comprises a non-skid backing on portions of frame 104 configured to contact vertical surface 102. Non-skid backing may be a rubber coating or cloth layer. The non-skid backing provides additional stability by inhibiting movement of frame 104 relative to vertical surface 102.

In an aspect, the length of frame 104 is adjustable. Frame 104 is comprised of two vertical members 108, horizontally positioned a distance less than an interior door apart and rigidly connected by five cross members 106 spaced at equal intervals along the length of vertical members 108. Vertical members 108 comprise four sections of equal length which are removably and rigidly interconnected. One or more vertical member 108 sections may be removed in order to reduce the length of frame 104. For example, removing one section from each vertical member 108 will reduce the length of frame 104 by one quarter. Reduction of the size of frame 104 allows drying device 101 to be used in more confined areas and facilitates its stability in confined areas.

Drying arm 110 comprises one or more drying areas 112 (shown, for clarity, only as drying area 112*b* in FIG. 1) and one or more connectors 114 (shown, for clarity, only as connections 114*c-d* in FIG. 1). Drying area 112 is configured to support assorted items during drying. In an aspect, drying area 112 has dimensions of approximately two feet by one and a half feet. Drying area 112 comprises three drying bars with a length of approximately two feet positioned in parallel with cross members 106 and two supports with length of approximately one and a half feet positioned in parallel with vertical member 108. Each support is rotatably connected to frame 104 on one end portion by connector 114. As will be appreciated by those skilled in the relevant art(s) after reading the description herein, connector 114 may be a bearing, an axle, pin or other suitable connection.

Supports are connected to one another via drying bars. The first drying bar is rigidly connected at each end portion to end portions of each support. The second drying bar is connected at each end portion to each support, approximately six inches away from the connection points of the first drying bar. The third drying bar is connected at each end portion to each support and positioned approximately six inches away from the connection points of the second drying bar and approximately twelve inches away from the first drying bar. Assorted items may be placed on drying area 112*b* of drying arm 110*b* in order to facilitate air drying. In some aspects, drying bars are round in order to prevent creasing the assorted items placed on the drying bars. In some aspects, drying device 101 may comprise multiple drying arms 110.

In an aspect, drying area 112 has dimensions of approximately two feet by one and a half feet. Drying area 112 comprises two supports with length of approximately one and a half feet positioned in parallel with vertical member 108 and a lattice stretched between the two supports and configured to support small assorted items while they dry and to allow air to pass through the lattice. In an aspect, the lattice is comprised of a cloth, plastic, or metal mesh. In another aspect, the lattice is a framework of closely-spaced, interconnecting rods.

In some aspects, drying rack 110 is connected to frame 104 via connection 114, and connection 114 is positioned directly above cross member 106. Drying arm 110 may be placed in two positions: a stored position (depicted in FIGS. 3 and 4) wherein drying arm 110 is parallel to frame 104, and a drying position wherein drying arm 110 is perpendicular to frame 104. In an aspect, drying arm 110 is supported while in the drying position by cross member 106 positioned directed below connection 114. Cross member 106 is rigidly connected to vertical member 108 and positioned to protrude one inch from vertical member 108. When drying arm 110 is in the drying position, drying arm 110 is in contact with the top portion of cross member 106, which supports drying arm 110 and any items placed thereon. Drying arm 110 is held in the stored position by one or more retainers 116 (shown, for clarity, only as retainer 116*a* in FIG. 1). Retainer 116 may be any device configured to removably hold drying arm 110 in a static, stored position.

Figure 2:
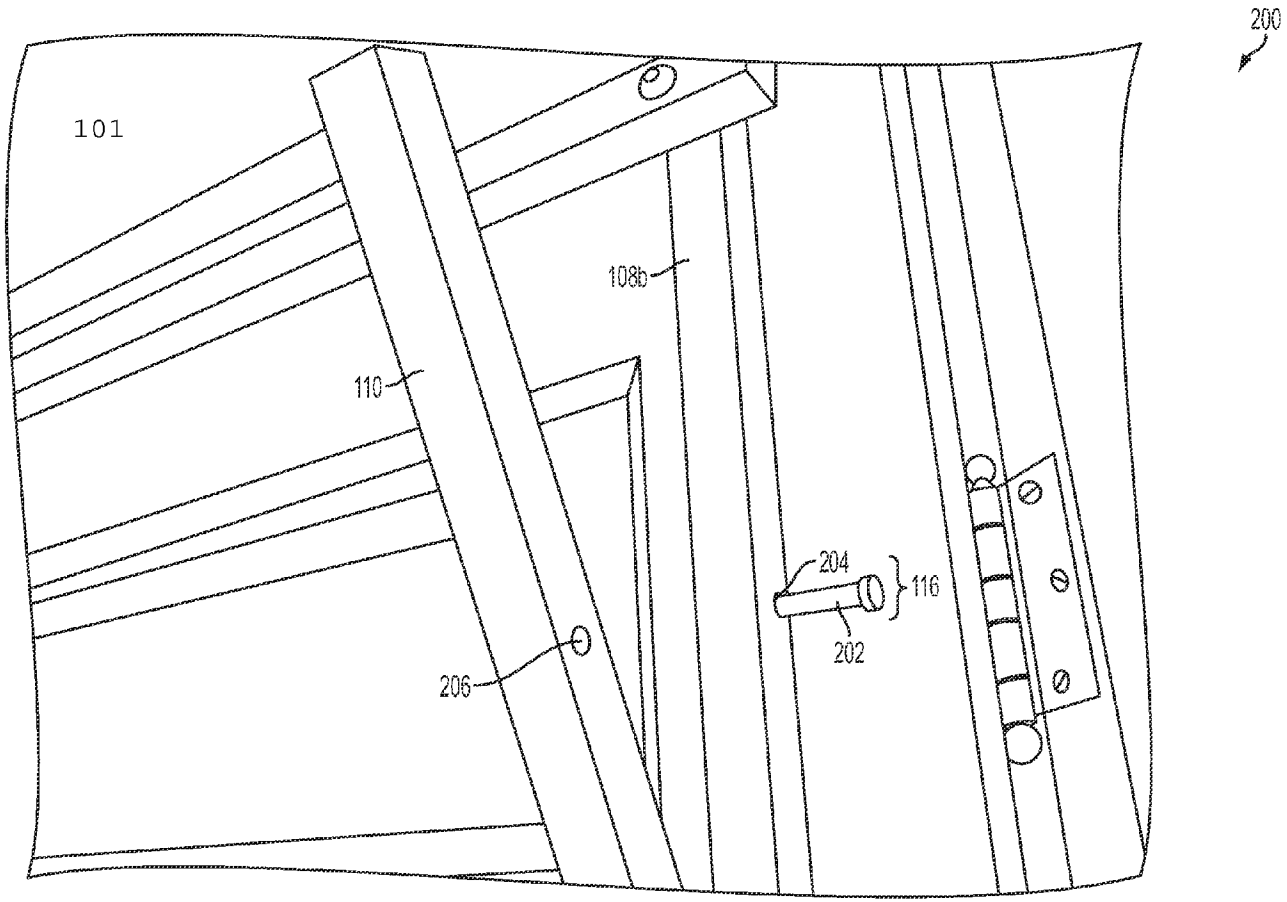
FIG. 2 is a detailed illustration of the front of an exemplary drying arm locking mechanism, in accordance with an aspect of the present disclosure.

Now referring to FIG. 2, a detailed illustration 200 of the front of an exemplary drying arm retainer 116, in accordance with an aspect of the present disclosure, is shown. In an aspect, retainer 116 comprises a cylindrical, rigid pin 202 configured to be removably inserted in a first cylindrical hole 204 in vertical member 108*b* and pass through a second cylindrical hole 206 in a portion of drying arm 110 when drying arm 110 is in the drying position. The second cylindrical hole 206 is positioned such that it aligns with the first cylindrical hole 204 when drying arm 110 is in the stored position (i.e., parallel to frame 104). Such a position is the lock position of drying arm retainer 116. When drying arm retainer 116 is not engaged with drying arm 110, drying arm retainer 116 is in a release position.

Figure 3:
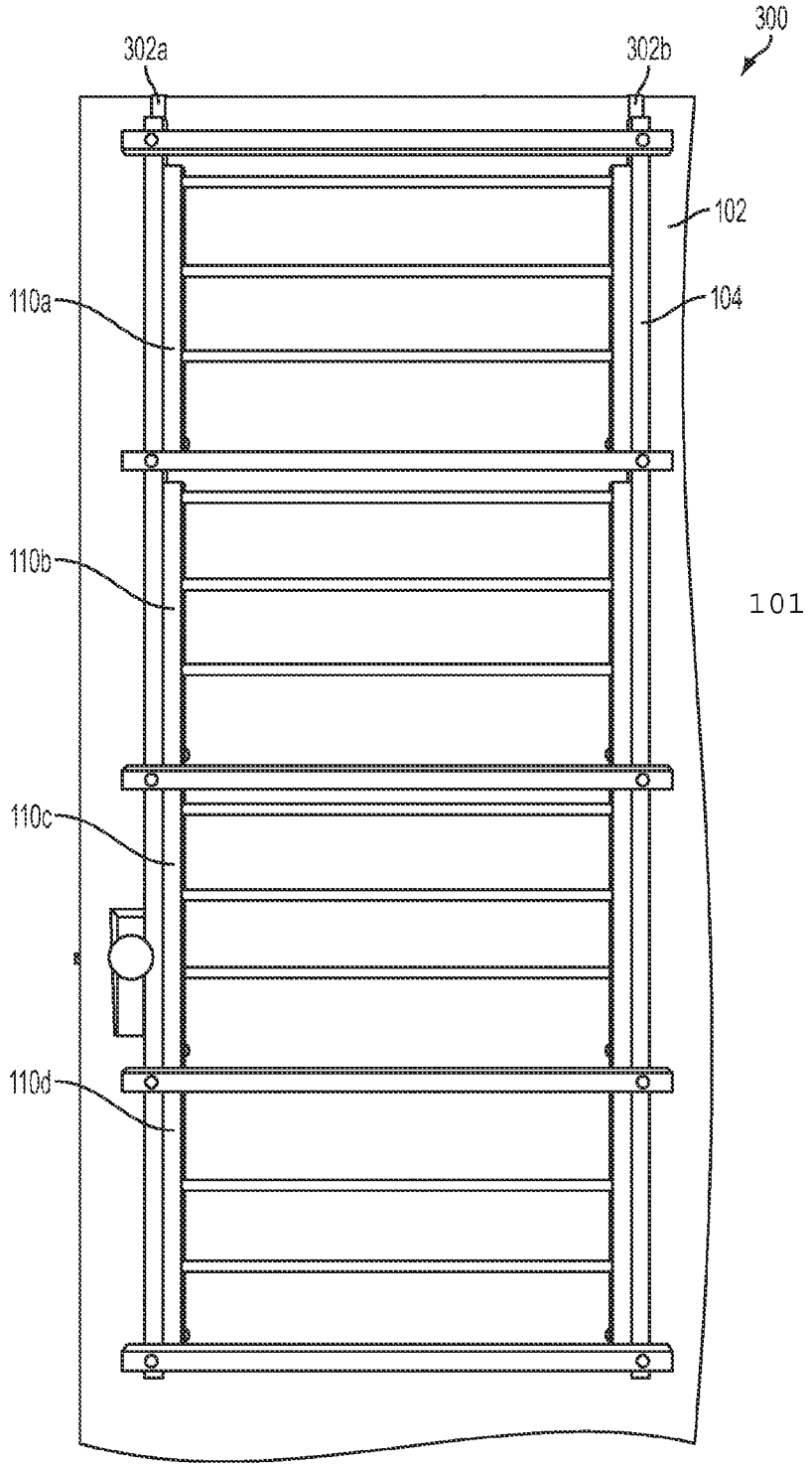
FIG. 3 is an illustration of a front view of an exemplary drying device wherein the device's drying arms are in the stored position, in accordance with an aspect of the present disclosure.
Figure 4:
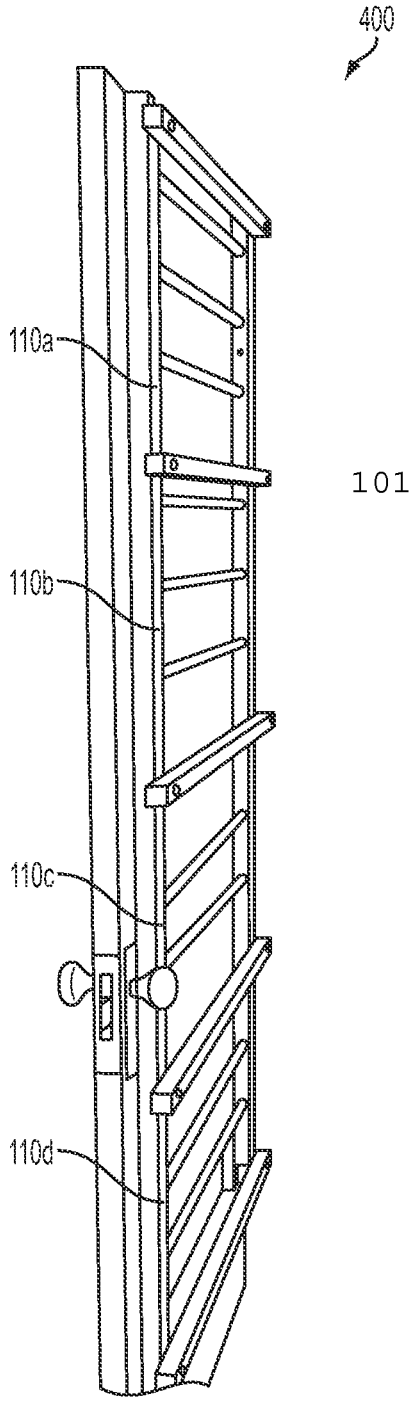
FIG. 4 is an illustration of a three-quarters view of the front of an exemplary drying device wherein the device's drying arms are in the stored position, in accordance with an aspect of the present disclosure.

Referring now to FIGS. 3 and 4, an illustration 300 of a front view and an illustration 400 of a three-quarters view of the front of an exemplary drying device 101 wherein its drying arms 110 are in the stored position, in accordance with aspects of the present disclosure, are shown.

Illustration 300 depicts drying arms 110 (shown as drying arms 110*a-d* in FIGS. 3 and 4) in their stored position (i.e., parallel to frame 104). Illustration 300 depicts the low profile of drying device 101 when drying arms 110 are in their stored positions. Drying device 101 is mounted to vertical surface 102 via one or more hooks 302 (shown as hooks 302*a-b* in FIG. 3) rigidly mounted to frame 104. Each hook 302 is a device configured to hang drying device 101 and assorted items placed on drying device 101 from vertical surface 102. In an aspect, hooks 302 comprise rigid portions of metal connected on one end portion to frame 104 and bent into a "U" or other shape suitable for hanging over the top portion of a door.

Figure 5:
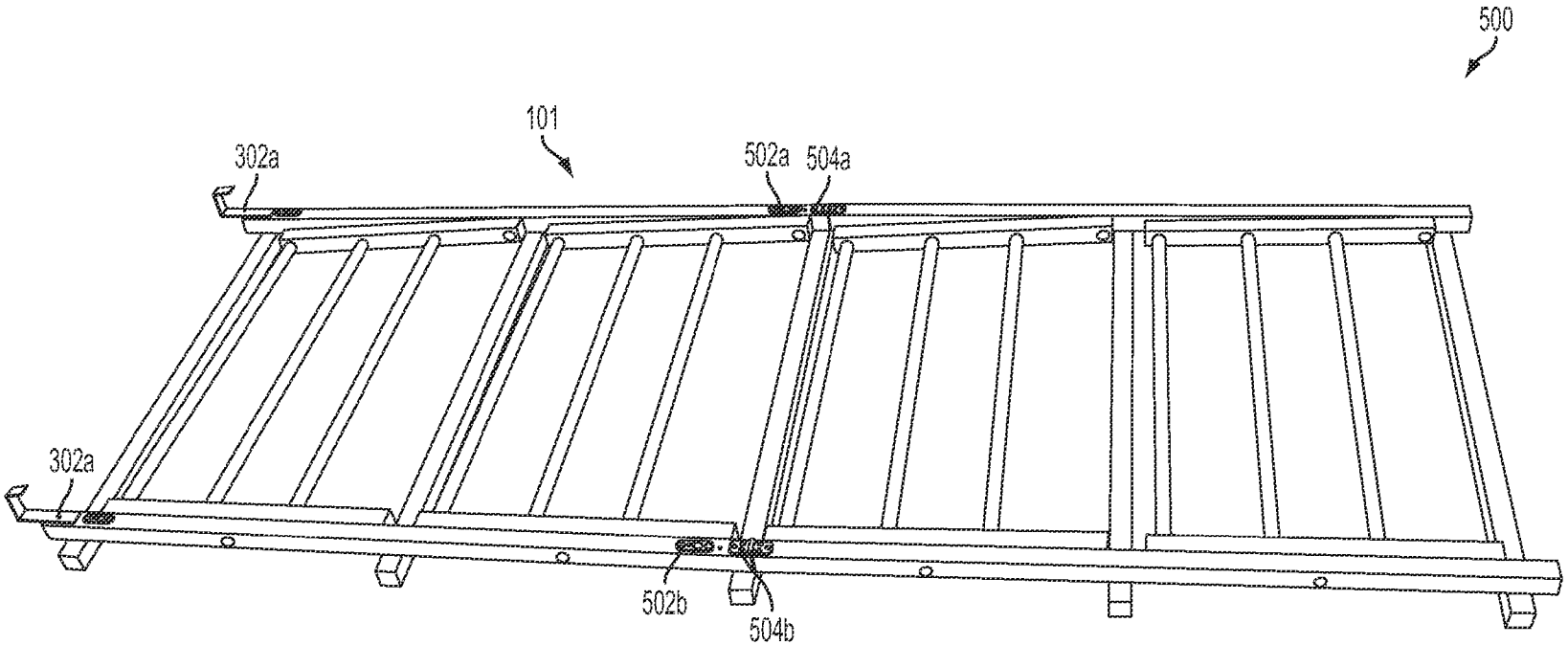
FIG. 5 is an illustration of a perspective view of the back of an exemplary drying device wherein the device's drying arms are in the stored position, in accordance with an aspect of the present disclosure.

Referring now to FIG. 5, an illustration 500 of a perspective view of the back of an exemplary drying device 101 wherein the device's drying arms 110 are in the stored position, in accordance with an aspect of the present disclosure, is shown.

In some aspects, drying device 101 is configured to be removably mounted to a vertical surface 102 such as a door, fence, or wall. Mounting is facilitated by one or more brackets 502 (for clarity, shown only as brackets 502*a-b* in FIG. 5). Bracket 502 is rigidly connected to drying device 101 on frame 104 and is configured to support the weight of the drying device 101 and any objects placed on the drying device 101 when placed on the vertical surface. In some aspects, brackets 502 support drying device 101 by removably attaching to a screw, nail, or other mounting member placed in the vertical surface 102. In an aspect, hook 302 is removable, allowing drying device 101 to be mounted on a door or a wall, depending on configuration.

Figure 6:
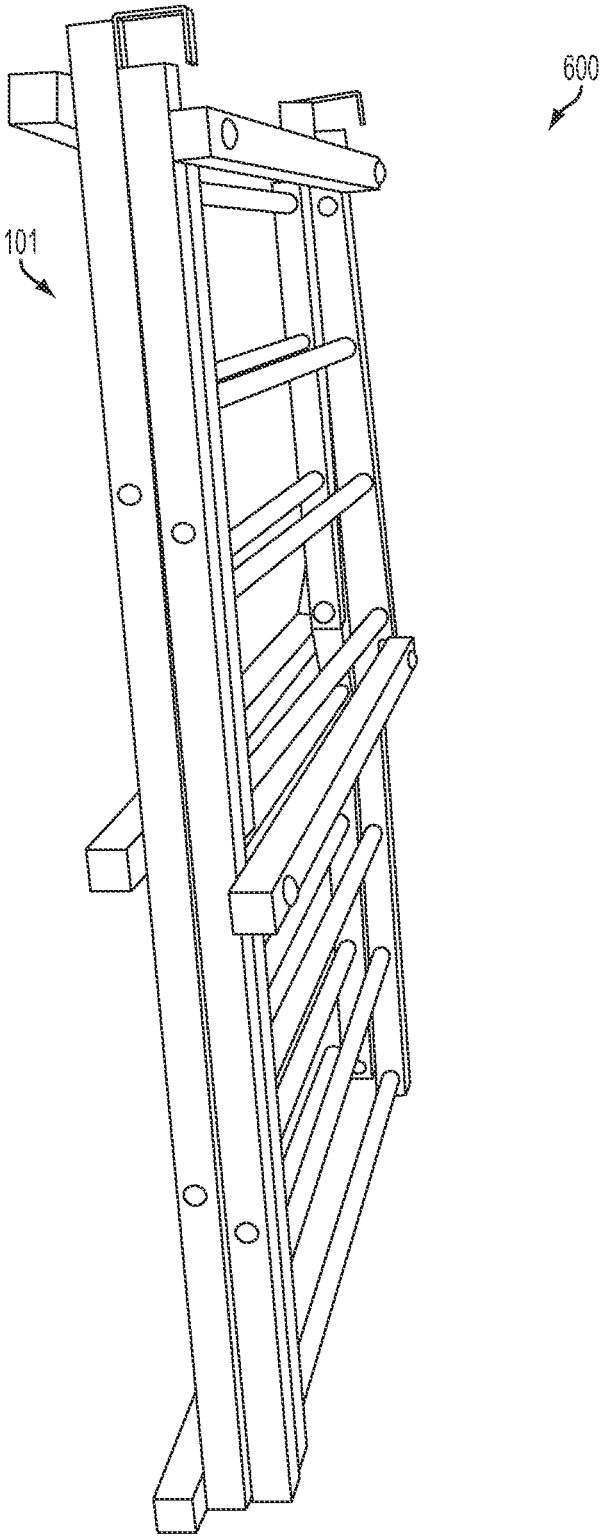
FIG. 6 is an illustration of a perspective view of an exemplary drying device wherein the device is folded for storage, in accordance with an aspect of the present disclosure.

In some aspects, drying device 101 is configured to be removably connected to vertical surface 102 and stored when it is not in use. In an aspect, vertical member 108 comprises two rigid bars connected together via one or more hinges 504 (shown as hinges 504*a-b* in FIG. 5). Vertical member 108 is configured such that frame 104 may be folded in half via hinges 504 when drying device 101 is not in use. As shown in illustration 600 of FIG. 6, drying device 101 occupies a volume with a similar width, half the height, and twice the thickness when it is not in use.

In other aspects, drying device 101 is configured to be separated into one or more portions for storage when not in use. In an aspect, drying arms 110 are rotatably connected to portions of frame 104. Frame 104 is divided into sections corresponding with drying arms 110. Each frame 104 section is removably connected to one or more frame sections via connection means such as locking pins and bolts. In other aspects, frame 104 sections are screwed together at end portions, enabling them to be rigidly connected and removably connected.

While various aspects of the present disclosure have been described above, it should be understood that they have been presented by way of example and not limitation. It will be apparent to persons skilled in the relevant art(s) that various changes in form and detail can be made therein without departing from the spirit and scope of the present disclosure. Thus, the present disclosure should not be limited by any of the above described exemplary aspects.

In addition, it should be understood that the figures in the attachments, which highlight the structure, methodology, functionality and advantages of the present disclosure, are presented for example purposes only. The present disclosure is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

What is claimed is:

1. A storable device for air drying assorted items, comprising:

a frame configured to be mounted on a vertical surface, comprising:

a first vertical member;

a second vertical member; and a plurality of cross members rigidly connected to the first and second vertical member in a horizontal orientation;

wherein a first cross member of the plurality of cross members is connected to the first vertical member at a first vertical member top portion via a first cross member first end portion and connected to the second vertical member at a second vertical member top portion via a first cross member second end portion, a mounting portion; and a plurality of drying arms connected for movement to the frame, a plurality of drying arm retainers positioned along the frame, moveable between a stored position and a drying position;

wherein each of the plurality of drying arm retainers is configured to prevent movement of a corresponding one of the plurality of drying arms when the corresponding one of the plurality of drying arms is in the stored position, wherein each of the plurality of drying arms is independently movable between the stored position and the drying position, the stored position not substantially protruding beyond the frame, and the drying position extending away from the frame, and wherein each of the plurality of drying arms is positioned directly above at least one of the plurality cross members, and wherein each of the plurality of drying arms is supported by at least one of the plurality of cross members in the drying position.

2. The storable device of claim 1, wherein the mounting portion is configured to be removably mounted to the vertical surface.

3. The storable device of claim 2, wherein the vertical surface is a door and the mounting portion comprises:

at least one hook mounted to a frame top portion configured to hang from a door top portion.

4. The storable device of claim 1, wherein the mounting portion comprises:

a first bracket mounted to the first vertical member; and a second bracket mounted to the second vertical member;

wherein each of the first bracket and the second bracket are configured to receive a mounting member connected to the vertical surface.

5. The storable device of claim 1, wherein the first and second vertical members each comprise an upper and lower element connected by a hinge, and wherein the frame is configurable between a folded storage position and an extended deployed position.

6. The storable device of claim 1, wherein each of the plurality of drying arm retainers comprises a cylindrical pin insertable in matching cylindrical holes in the plurality of drying arms and the first and second vertical members.

7. The storable device of claim 1, wherein, when one of the plurality of drying arms is in the drying position, the one of the plurality of drying arms is perpendicular to the frame.

8. The storable device of claim 1, wherein the storage device is constructed of one of:

metal;

plastic; and wood.

9. The storable device of claim 1, wherein the plurality of drying arms consists of four drying arms.

10. The storable device of claim 1, wherein each of the plurality of drying arms comprises:

a first drying arm support rotatably connected to the first vertical member at a first drying arm support connector;

a second drying arm support rotatably connected to the second vertical member at a second drying arm support connector, positioned in parallel with the first drying arm support; and a plurality of drying bars being evenly spaced and generally parallel, interconnecting the first drying arm support and the second drying arm support, configured to support at least one drying item.

11. The storable device of claim 10, wherein the distance between drying arms connected to the frame is greater than a length of the first or second drying arm support.

12. A method of air drying assorted items, comprising:

assembling a frame configured to be mounted to a vertical surface, wherein the frame comprises:

a first vertical member;

a second vertical member; and a plurality of cross members rigidly connected to the first and second vertical member in a horizontal orientation;

wherein a first cross member of the plurality of cross members is connected to the first vertical member at a first vertical member top portion via a first cross member first end portion and connected to the second vertical member at a second vertical member top portion via a first cross member second end portion, attaching a mounting portion allowing the frame to hang from a vertical surface; and connecting a plurality of drying arms to the frame, allowing the plurality of drying arms to rotate, positioning a plurality of drying arm retainers along the frame, moveable between a stored position and a drying position;

wherein each of the plurality of drying arm retainers is configured to prevent movement of a corresponding one of the plurality of drying arms when the corresponding one of the plurality of drying arms is in the stored position, wherein each of the plurality of drying arms is independently movable between the stored position and the drying position, the stored position not substantially protruding beyond the frame, and the drying position extending perpendicular from the frame, and wherein each of the plurality of drying arms is positioned directly above at least one of the plurality cross members, and wherein the each of the plurality of drying arms is supported by at least one of the plurality of cross members in the drying position.

13. The method of air drying assorted items of claim 12, wherein the first and second vertical members each comprise an upper and lower element connected by a hinge, and wherein the frame is configurable between a folded storage position and an extended deployed position.

14. The method of air drying assorted items of claim 12, wherein each of the plurality of drying arm retainers comprises a cylindrical pin insertable in matching cylindrical holes in the plurality of drying arms and the first and second vertical members.

15. A kit for a storable device for air drying assorted items, comprising:

a frame comprising:

a first vertical member;

a second vertical member; and a plurality of cross members;

a mounting portion; and a plurality of drying arms connectable to the frame for rotational movement, a plurality of drying arm retainers positioned along the frame, moveable between a stored position and a drying position;

wherein each of the plurality of drying arm retainers is configured to prevent movement of a corresponding one of the plurality of drying arms when the corresponding one of the plurality of drying arms is in the stored position, wherein each of the plurality of drying arms is independently movable between the stored position and the drying position when attached to the frame, the stored position not substantially protruding beyond the frame, and the drying position extending away from the frame, and wherein each of the plurality of drying arms is configured to be positioned directly above at least one of the plurality cross members, and wherein each of the plurality of drying arms when attached to the frame is supported by at least one of the plurality of cross members in the drying position.

* * * * *